US011459777B2

(12) United States Patent
Jablonski

(10) Patent No.: US 11,459,777 B2
(45) Date of Patent: Oct. 4, 2022

(54) PUMP JACK CENTERING ROLLER SYSTEM

(71) Applicant: Alum-A-Pole Corporation, Scranton, PA (US)

(72) Inventor: Kevin Jablonski, Scranton, PA (US)

(73) Assignee: ALUM-A-POLE CORPORATION, Scranton, PA (US)

( * ) Notice: Subject to any disclaimer, the term of this patent is extended or adjusted under 35 U.S.C. 154(b) by 520 days.

(21) Appl. No.: 16/521,776

(22) Filed: Jul. 25, 2019

(65) Prior Publication Data

US 2020/0048916 A1 Feb. 13, 2020

Related U.S. Application Data

(60) Provisional application No. 62/717,985, filed on Aug. 13, 2018.

(51) Int. Cl.
*E04G 5/06* (2006.01)
*E04G 1/20* (2006.01)

(52) U.S. Cl.
CPC ..... *E04G 5/061* (2013.01); *E04G 1/20* (2013.01); *A63B 2209/00* (2013.01)

(58) Field of Classification Search
CPC ..... E04G 1/20; E04G 5/061; E04G 5/067; A63B 27/02; A63B 27/04
See application file for complete search history.

(56) References Cited

U.S. PATENT DOCUMENTS 1,270,906 A * 7/1918 Whitney ..... A63B 27/00 182/136
3,340,961 A * 9/1967 Provaznik ..... A63B 27/02 182/134
4,463,828 A * 8/1984 Anderson ..... A63B 27/00 182/136
4,597,471 A * 7/1986 Anderson ..... A63B 27/04 182/132
4,942,941 A * 7/1990 Anderson ..... A63B 27/00 182/136
5,259,478 A * 11/1993 Berish ..... A63B 27/00 182/136
5,884,725 A * 3/1999 Reyland ..... E04G 1/20 182/82
5,909,783 A * 6/1999 Berish ..... E04G 1/20 182/146
5,975,241 A * 11/1999 Berish ..... A63B 27/00 182/136

* cited by examiner

*Primary Examiner* — Colleen M Chavchavadze
(74) *Attorney, Agent, or Firm* — Myers Wolin, LLC

(57) ABSTRACT

A roller system including a top roller, a middle roller, a split lower roller and a split workbench roller configured for a pump jack arranged for travelling up and down a pole, wherein the top roller includes flanges at both ends of the roller; wherein the split lower roller includes a pair of facing lower rollers, each of the pair of facing lower rollers having an outward tapered flange; and wherein the split workbench roller includes a pair of facing workbench rollers, each of the pair of facing workbench rollers having an outward tapered flange.

20 Claims, 10 Drawing Sheets

PUMP JACK CENTERING ROLLER SYSTEM

CROSS-REFERENCE TO RELATED APPLICATIONS

This application claims the benefit of U.S. Application 62/717,985 filed Aug. 13, 2018, the contents of which are incorporated herein by reference.

FIELD OF THE INVENTION

This invention relates generally to scaffold equipment, and more particularly to a roller system for use in a pump jack that travels up and down a pole. For example, the roller system may be incorporated into the PRO-JACK and PRO-BENCH systems manufactured by ALUM-A-POLE Corp.

BACKGROUND

Typically a pump jack includes a frame with an upper and lower shackle member supported by the frame. A pump arm is pivotally provided onto the frame which operates the shackles in alternating relationship. The pump arm serves to have the upper shackle in a twist gripping relationship securing onto the pole while it then serves to raise up the frame to step it upward along the pole. The weight then shifts so that the lower shackle grips the pole and the upper shackle steps up to a next position on the pole. In this manner, the non-gripping shackle steps up the pole while the opposing shackle grips the pole. To ride the pump jack down the pole, the lower shackle is released from its gripping relationship and the upper shackle is rolled down the pole by means of a handle.

A popular pump jack pole is formed of elongated hollow metal with a rubberized surface on only one side of the pole. Such poles were found to be extremely strong, long-lasting and easier to manipulate than the standard wooden poles. The pump jack pole usually has a safety label attached to a face of the pole to warn users about the potential dangers of operating the pump jack with the pole. The pump jack is generally equipped with rollers to allow for smooth up and down movement along the pole. Furthermore, the pump jack typically requires spacers or other centralizing parts placed on the internal sides of the brackets so as to provide a snug fit against the sides of the pole. As the pump jack moves up and down along the pole, the internal spacers or other centralizing parts would scrape the safety label and, over time, the warning information on the label may become illegible to the users. The use of spacers or centralizing parts means that the pump jack is more complex and has more parts to maintain. Therefore, there is a need for an improved roller system that centers the pump jack and thus eliminates the internal centralizing parts, and also avoids scraping of the safety labels on the pole.

Also, the rollers themselves would be worn over time as they scrape against the surface of the pole, and thus require replacement. Typically the roller is a one-piece design which would lead to seam (parting line), seam failure (cracking) and offset mating problems from the manufacturing process. Seams can also restrict the roller from rolling causing it to slide and wear a flat spot resulting in harder operation and require replacement sooner. Therefore, there is a need for an improved roller system that eliminates the above noted problems associated with the single roller design.

SUMMARY

In one embodiment, the present invention provides a roller system including a top roller, a middle roller and a split lower roller configured for a pump jack arranged for travelling up and down a pole, wherein the pump jack includes a frame member; a bracket member supported on the top of said frame member, said bracket member supporting a front rod; a lower shackle member supported on said frame member, having a front and rear clamping bars configured to apply a coupling force for gripping the pole, wherein the rear clamping bar is inserted into a split lower roller; a pump arm pivotally coupled to said frame member; an upper shackle member pivotally coupled to said pump arm, having a front rod and a rear rod configured to apply a coupling force for gripping the pole, wherein the rear rod is inserted into a middle roller; a biasing means responsive to the pumping action of the pump arm configured to alternately position one of said shackle members in gripping relationship with the pole; said pump arm pivotally stepping upward said frame member during a pump stroke while said upper shackle member grips the pole and pivotally stepping upward said upper shackle member during a reverse stroke while said lower shackle member grips the pole; a release means configured to disengage said lower shackle member from the pole, and a handle means coupled to said front rod configured to roll the pump jack down the pole; wherein the front rod is inserted into the top roller configured to roll along a front surface of the pole; wherein the rear rod is inserted into the middle roller; wherein the rear clamping rod is inserted into the split lower roller, and the split lower roller includes a pair of facing lower rollers, each of the pair of facing lower rollers having an outward tapered flange.

In one embodiment the present invention provides a pump jack arranged for travelling up and down a pole, including: a frame member; a bracket member supported on the top of said frame member, said bracket member supporting a front rod inserted into a top roller configured to roll along a front surface of the pole; a lower shackle member supported on said frame member, having a front clamping bar and a rear clamping rod configured to apply a coupling force for gripping the pole, wherein the rear clamping rod is inserted into a split lower roller; a pump arm pivotally coupled to said frame member; an upper shackle member pivotally coupled to said pump arm, having a front rod and a rear rod configured to apply a coupling force for gripping the pole, wherein the rear rod is inserted into a middle roller; a biasing means responsive to the pumping action of the pump arm configured to alternately position one of said shackle members in gripping relationship with the pole; said pump arm pivotally stepping upward said frame member during a pump stroke while said upper shackle member grips the pole and pivotally stepping upward said upper shackle member during a reverse stroke while said lower shackle member grips the pole; a release means configured to disengage said lower shackle member from the pole, and a handle means coupled to said front rod configured to roll the pump jack down the pole; wherein the top roller includes flanges at both ends of the roller; wherein the split lower roller includes a pair of facing lower rollers, each of the pair of facing lower rollers having an outward tapered flange.

DETAILED DESCRIPTION OF THE PREFERRED EMBODIMENTS

Figure 1:
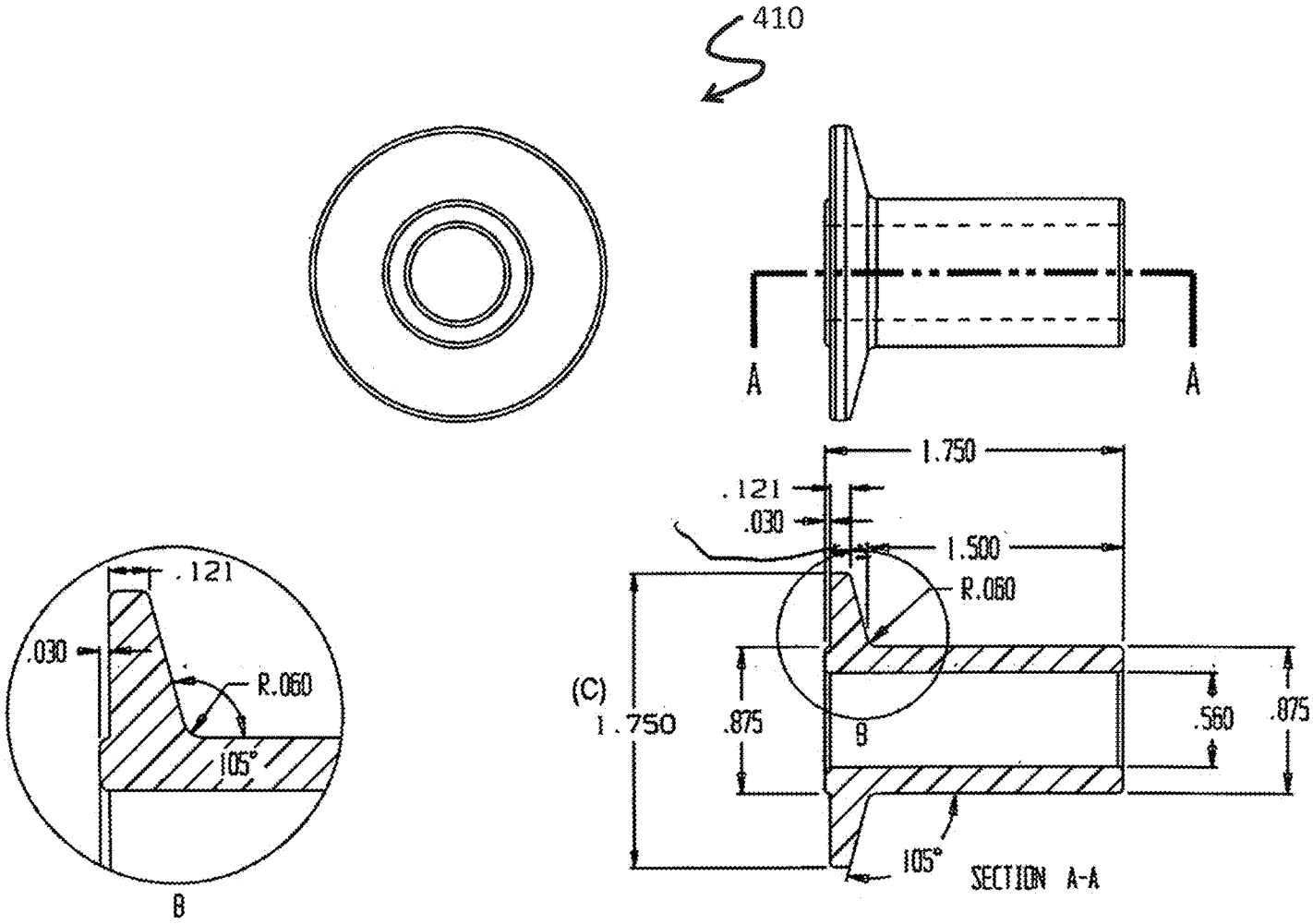
FIG. 1 shows the front, side, cross-sectional and expanded views of one of the pair of split lower jack rollers according to an embodiment.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

A roller system according to an embodiment includes a split lower jack roller with outward tapered flanges, a single middle jack roller without flanges, and a single top jack roller with non-tapered flanges. If the pump jack includes a workbench, the roller system further includes a split top workbench roller with tapered flanges.

Figure 2:
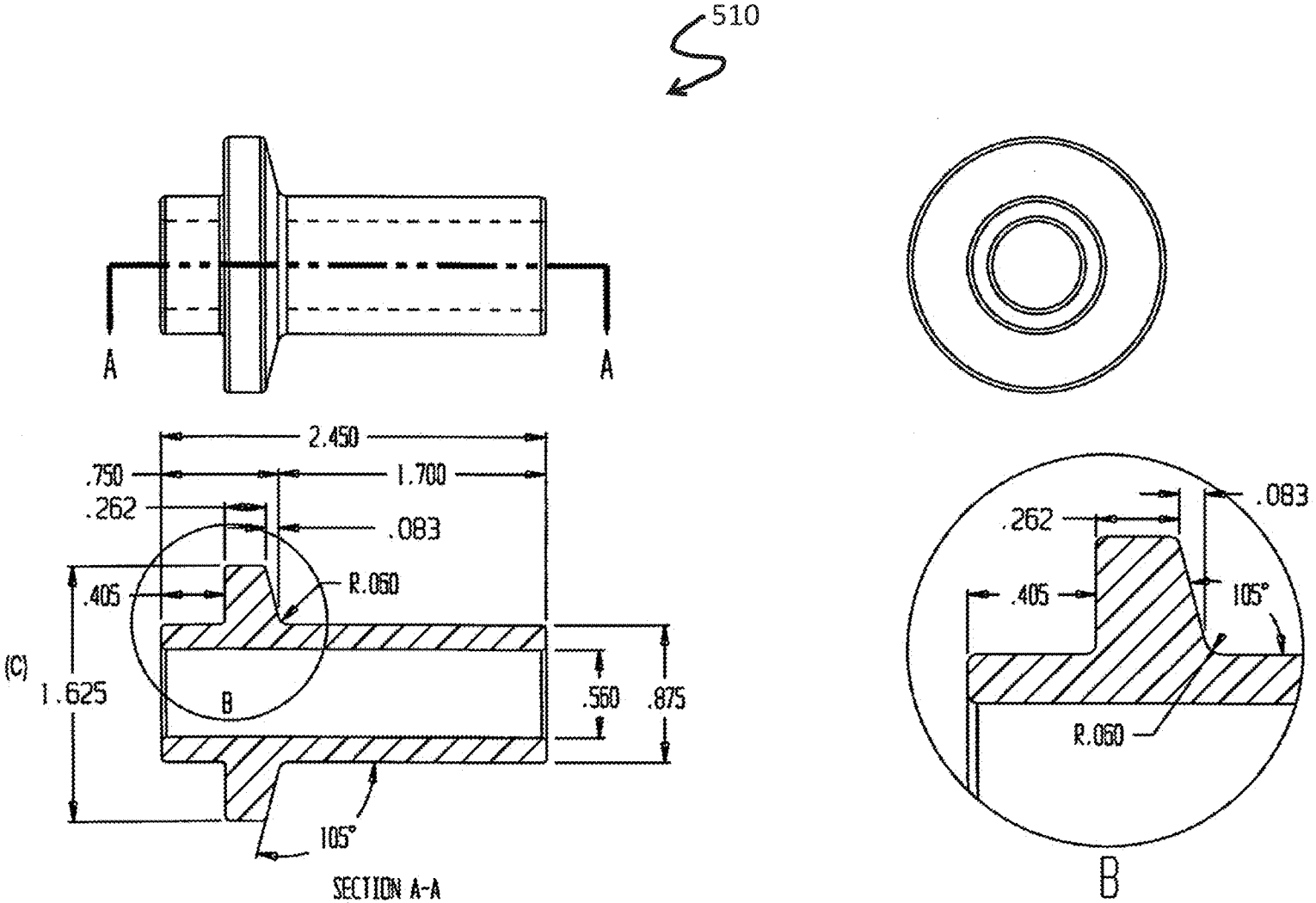
FIG. 2 shows the front, side, cross-sectional and expanded views of one of the pair of split top workbench rollers according to an embodiment.
Figure 3:
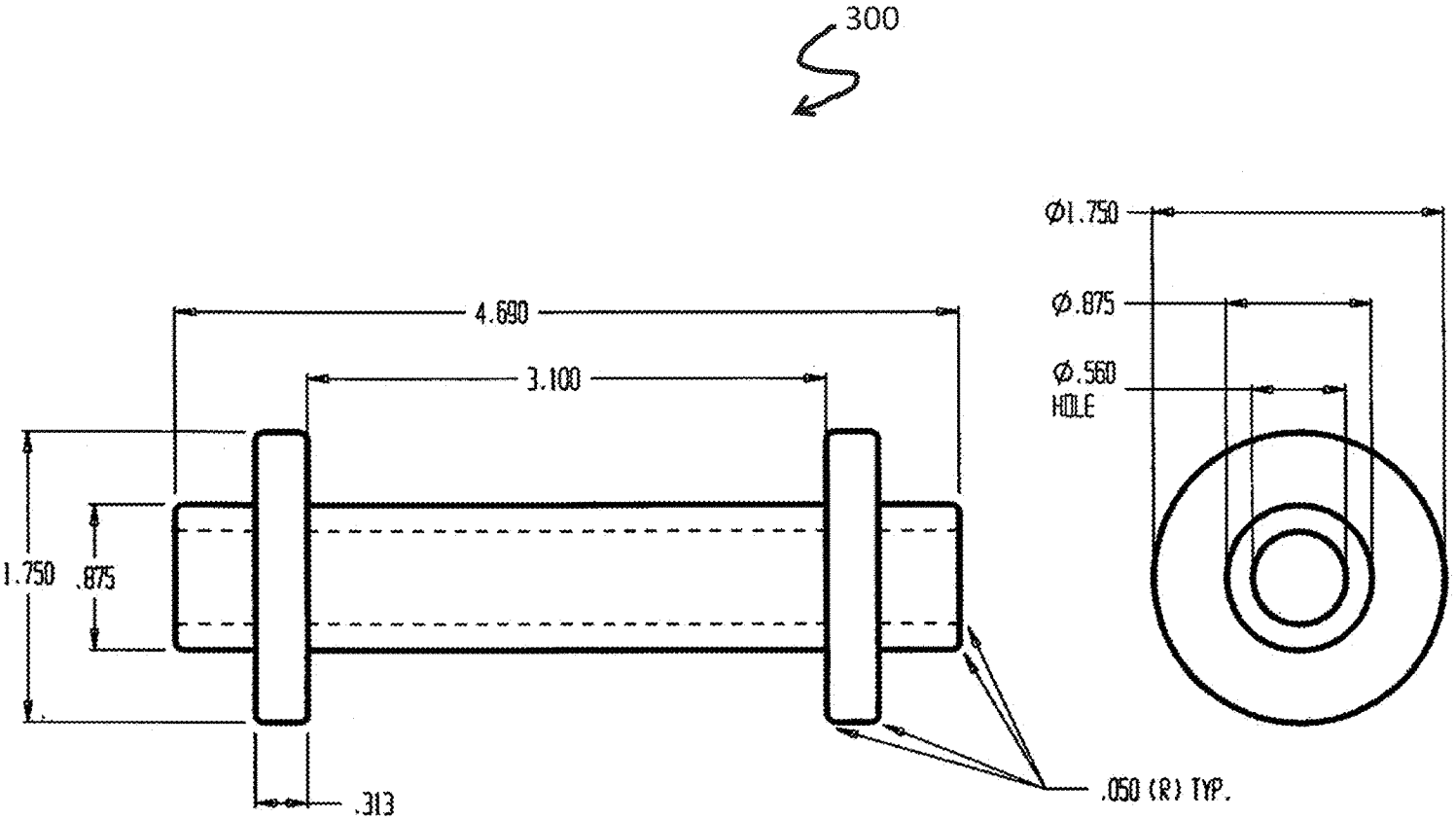
FIG. 3 shows the front and side views of a single top jack roller according to an embodiment.
Figure 4:
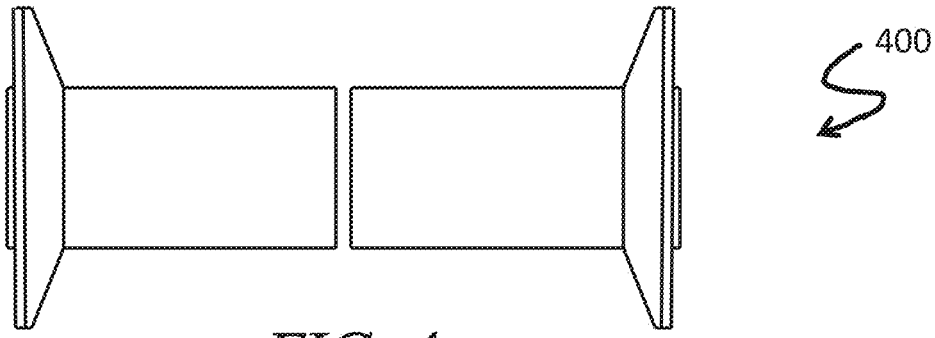
FIG. 4 shows a pair of split lower jack rollers according to an embodiment.
Figure 5:
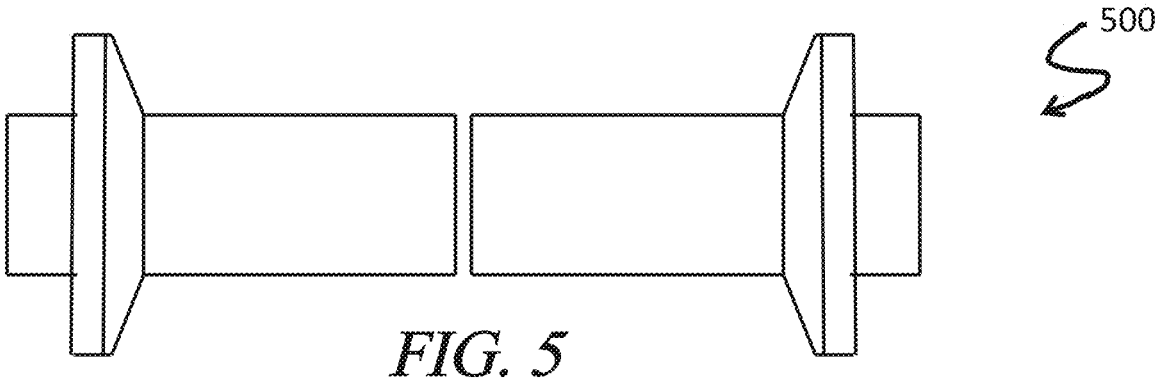
FIG. 5 shows a pair of split top workbench rollers according to an embodiment.
Figure 6:
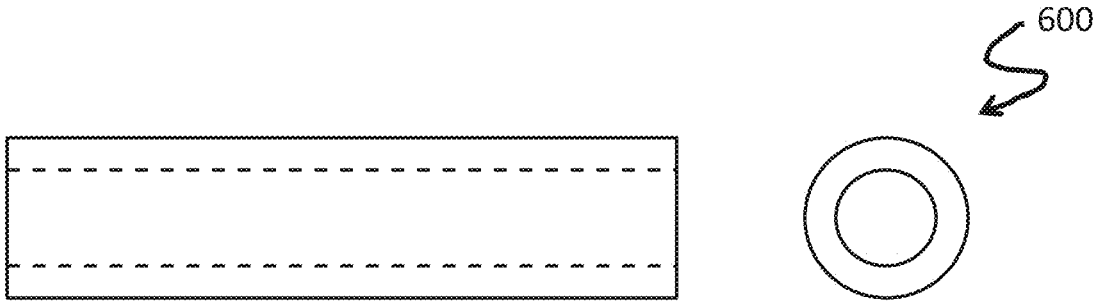
FIG. 6 shows the front and side view of a middle jack roller according to an embodiment.

FIGS. 1-6 show the rollers of a roller system according to an embodiment. FIG. 1 shows the front, side, cross-sectional and expanded views of one of the pair of lower rollers 410, with typical example dimensions, and FIG. 4 shows a split lower jack roller 400 including a pair of the lower rollers facing each other such that the flanges are arranged at opposite ends. FIG. 2 shows the front, side, cross-sectional and expanded views of one of the pair of (workbench) top rollers 510, with typical example dimensions, and FIG. 5 shows a top workbench roller 500 including a pair of the top rollers facing each other such that the flanges are arranged at opposite ends. Note that the tapered flanges at both ends of the roller 400, 500 would cause the pump jack to center-align with the pole. FIG. 3 shows the front and side views of a single top jack roller 300, with typical dimensions. FIG. 6 shows the front and side view of a middle jack roller 600.

In order to better understand the various roles the rollers play in the pump jack according to an embodiment, an existing pump jack is briefly discussed below, together with the indication of improvements made by the roller system where appropriate. Details of some pump jack examples may be found in the patent documents U.S. Pat. Nos. 4,463,828 and 4,597,471, the contents of which are hereby incorporated by reference.

Figure 7:
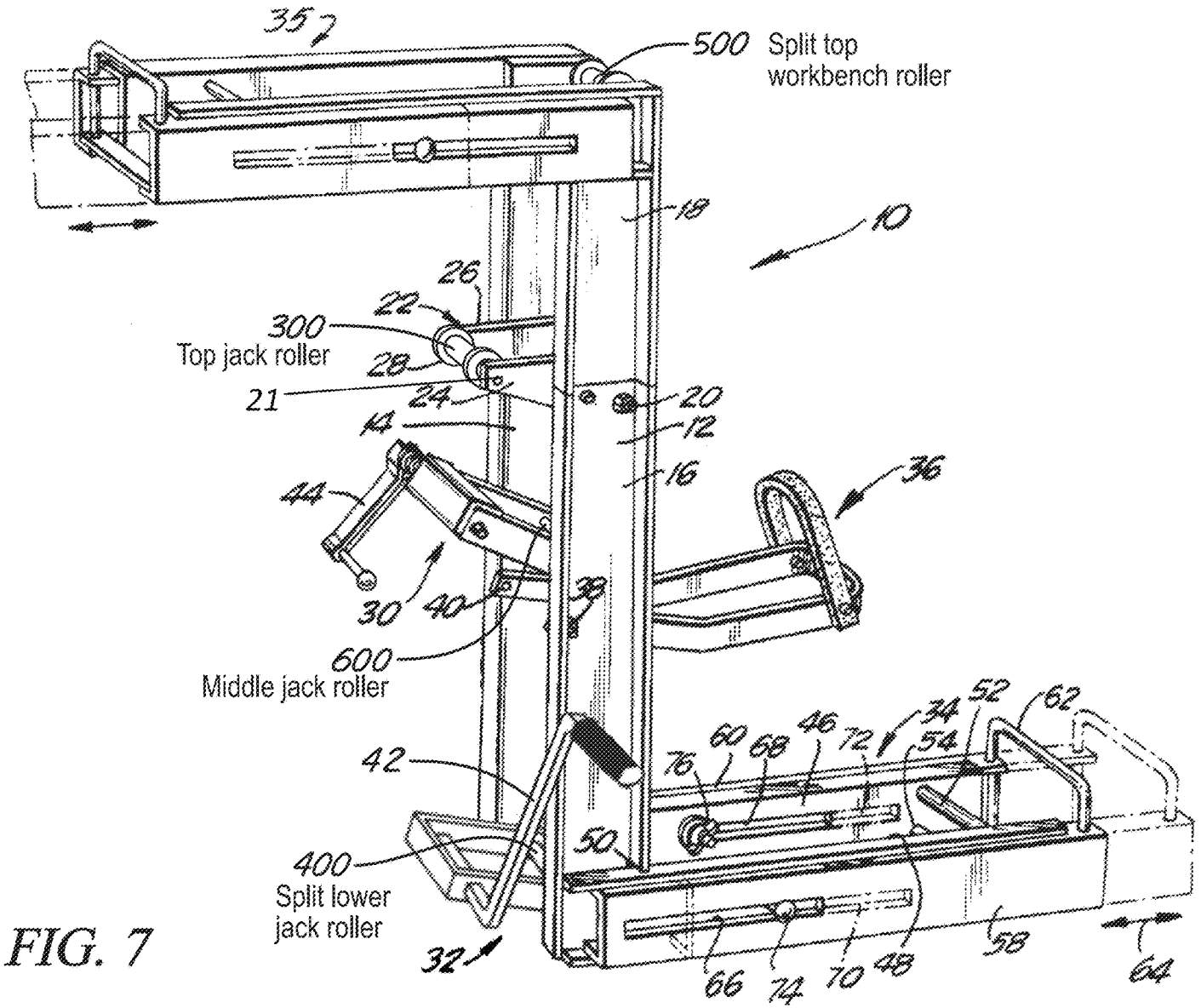
FIG. 7 shows an example pump jack.

FIG. 7 is an example pump jack, shown generally at 10, including a frame member having opposing pairs of vertical posts 12, 14. The vertical posts are shown as being formed of substantially U-shaped channels which are spaced apart and can straddle the pump jack pole. The particular channels are shown to include a lower section 16 and an upper section 18 which can be bolted together at 20. An upper bracket member 22 spaces apart the opposing side walls 12, 14. The bracket member 22 includes side plates 24, 26, with a front roller 28. The middle roller 600 and the lower split roller 400 are not visible in FIG. 7, but are respectively shown in FIGS. 8 and 9.

Figure 10:
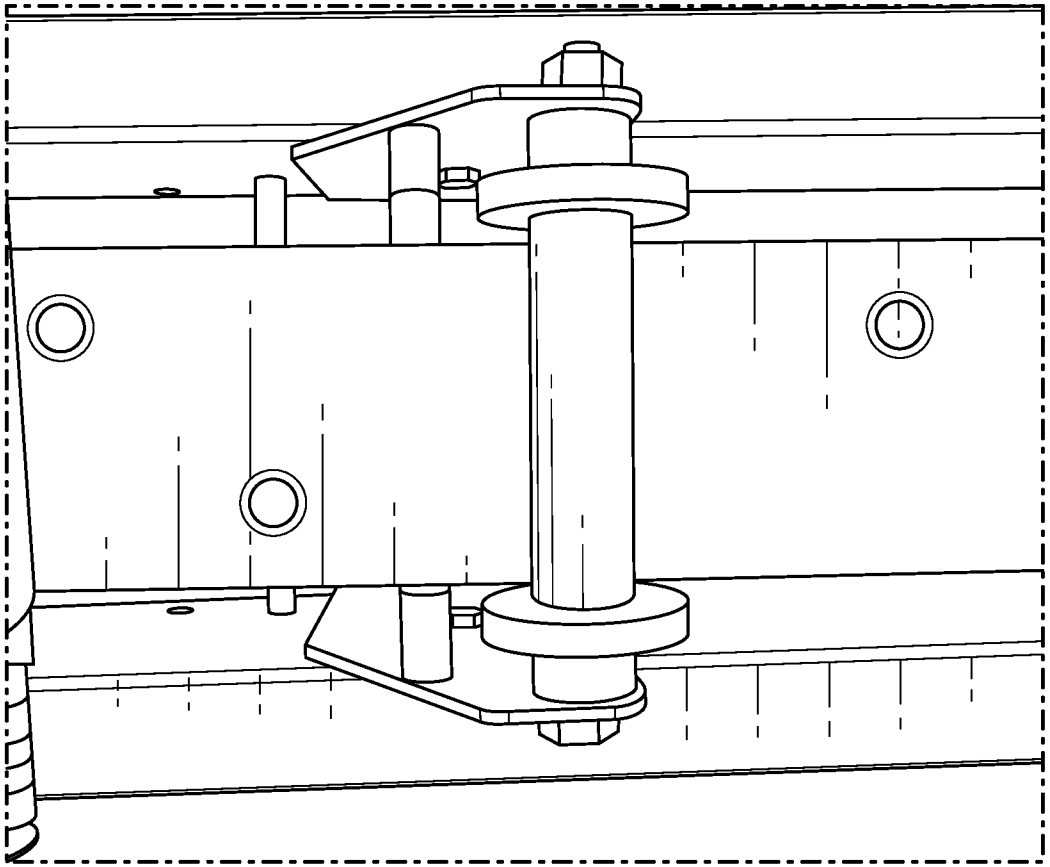
FIG. 10 shows a top jack roller installed with the side plates according to an embodiment.
Figure 11:
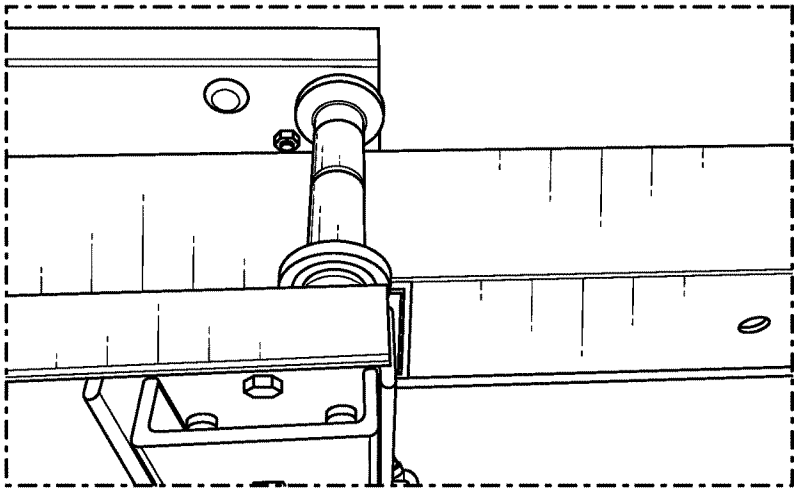
FIG. 11 shows a picture of a pair of split top workbench rollers installed with the workbench according to an embodiment.
Figure 12:
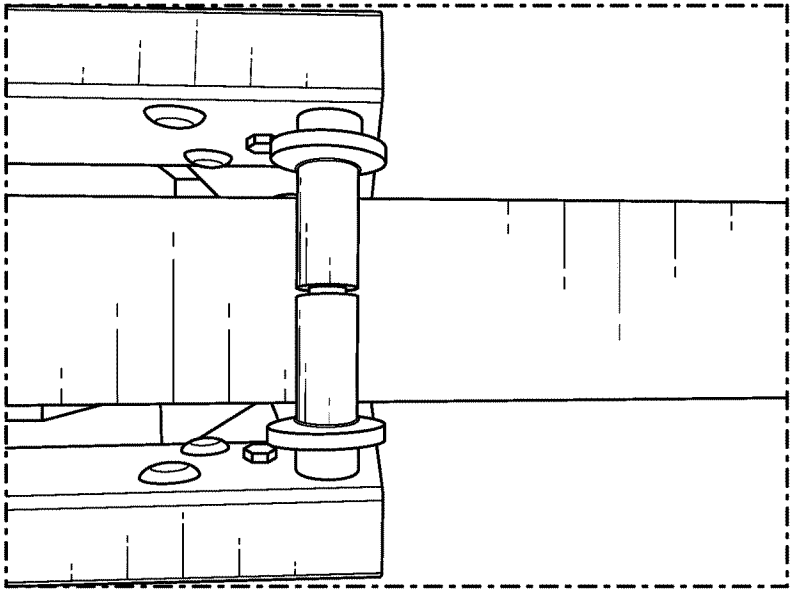
FIG. 12 shows a picture of a pair of split top workbench rollers installed with the workbench according to an embodiment.

In one embodiment, the spacer 22 is inserted into a single top jack roller 300 with non-tapered flanges, such as the one shown in FIG. 3. A picture of a top jack roller installed with the side plates according to an embodiment is shown in FIG. 10. Also shown in FIG. 7 is a top workbench rod is inserted into a pair of split top workbench rollers with tapered flanges 500, such as the one shown in FIG. 5. Pictures of a pair of split top workbench rollers installed with the workbench are shown in FIGS. 11 and 12.

As is well known in the operation of a pump jack, there is provided an upper shackle member 30 and a lower shackle member 32. There is also provided a first support arm 34 projecting in one direction. A second support arm 35 is also shown at the upper end projecting in the opposing direction. A pump support arm 36 is utilized to control the pumping action for climbing up of the pump jack along the pump jack pole.

As is known within the pump jack art, the pump arm 36 is utilized to have the upper and lower shackles alternately grip onto the pole. The non-gripping shackle climbs up the pole.

In order to lower the pump jack down the pole, the release lever 42 pushes the lower shackle forward. The handle 44 is then utilized to roll down the pump jack along the pump jack pole with the upper shackle gripping the pole during the rolling down operation.

Figure 8:
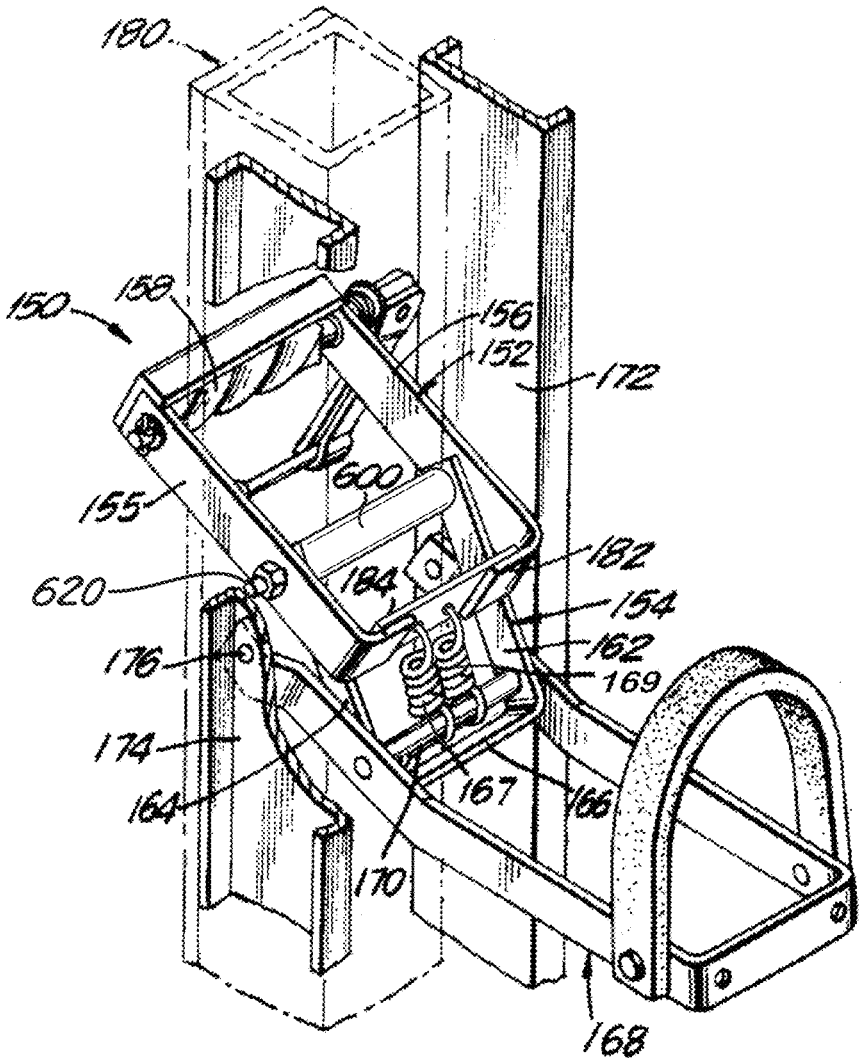
FIG. 8 shows the upper shackle of an example pump jack.

As shown in FIG. 8, the upper shackle 150 includes a yoke member 152 and a linkage member 154. The yoke member 152 includes the opposing side plates 155, 156, the forward gripping roller 158 and a single middle jack roller without flanges 600 inserted by a rod 620. The linkage member 154 is formed of a U-shaped member having opposing side legs 162, 164 and a rear connecting bight plate 166.

The rear of the linkage member 154 is pivotally connected to the pump arm 168 by means of the connecting bar 170. The pump arm 168, in turn, is pivotally connected between the side walls 172, 174 of the pump jack by means of the pivot pin 176. Spring biasing is provided by means of the tension springs 167, 169 extending between the inwardly directed ears 182, 184 at the distal ends of the yoke member and the connecting bar 170. The pole 180 passes through the yoke member 152.

Figure 9:
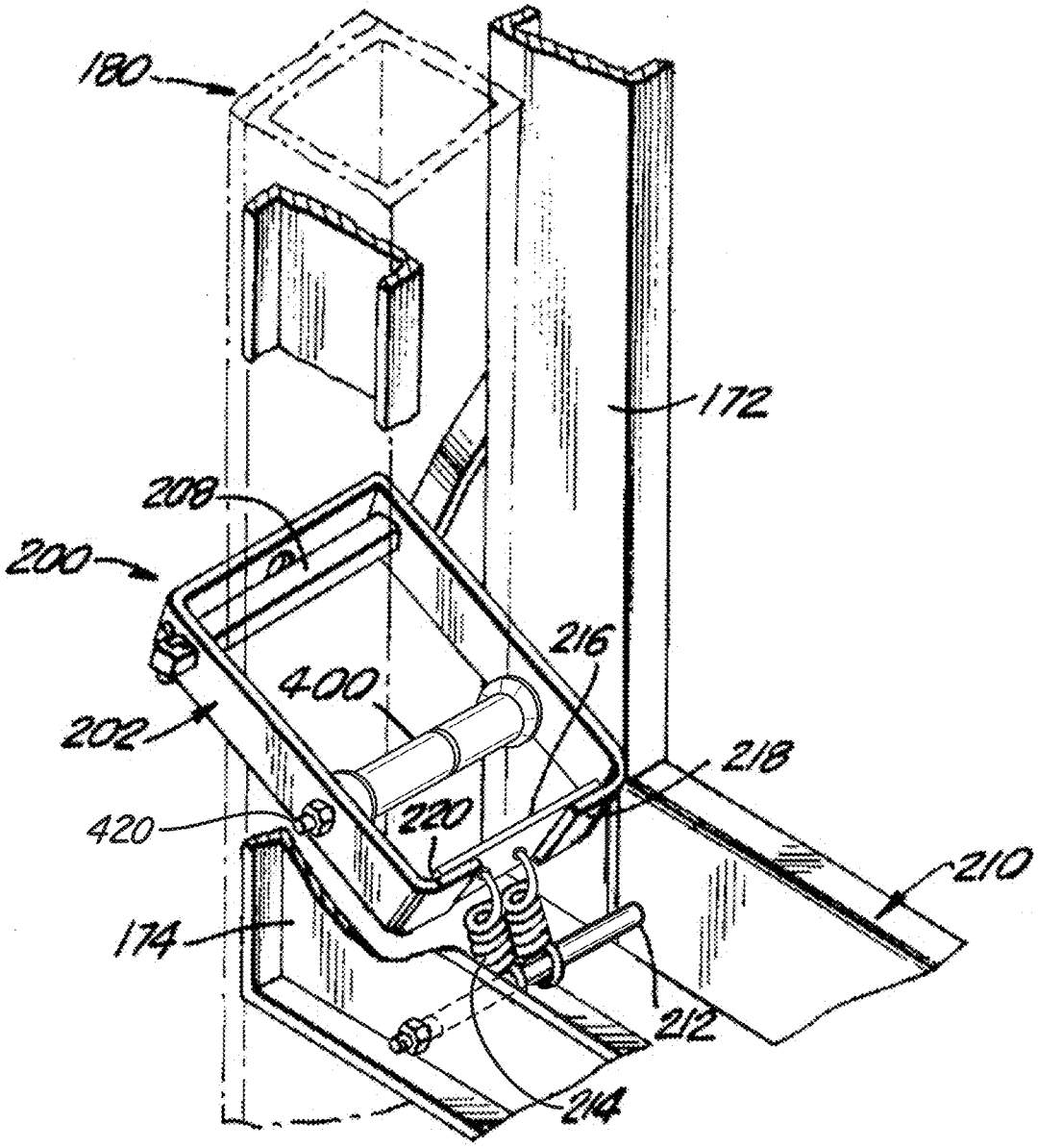
FIG. 9 shows the lower shackle of an example pump jack.

In FIG. 9, the lower shackle 200 is shown to include a yoke member 202. Yoke member 202 pivots on the rod 420, which serves as the rear gripping rod of the yoke member 202. The forward gripping rod 208 is also provided at the front end of the yoke member 202.

In the case of the lower shackle, the yoke member 202 is connected to the support arm 210 by means of the connecting rod 420. Again, spring biasing is provided by means of the tension springs 214, 216 extending between the inwardly directed ears 218, 220 at the distal ends of the yoke member and the connecting rods 212. The pole 180 would extend within the yoke member.

Figure 13:
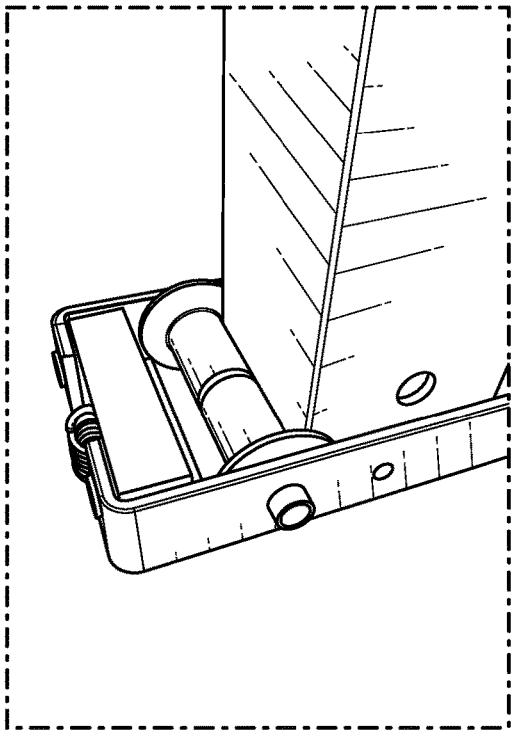
FIG. 13 shows a picture of a pair of split lower rollers installed in the lower shackle according to an embodiment.
Figure 14:
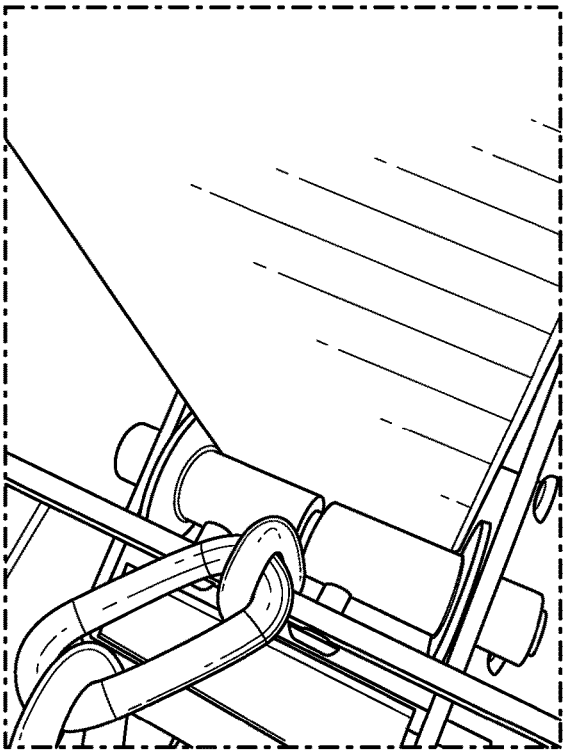
FIG. 14 shows a picture of a pair of split lower rollers installed in the lower shackle according to an embodiment.

In one embodiment, the pivot rod 420 is inserted into a pair of lower jack rollers with outward tapered flanges 400, such as the one shown in FIG. 4. Pictures of a pair of split lower rollers installed in the lower shackle are shown in FIGS. 13 and 14. Note also that in FIG. 13, the tapered flanges of the roller prevent the scraping of the label on the pole.

The rollers in the roller system may be made of any suitable materials and methods. In one embodiment, the rollers are made of super tough nylon. Note that the two piece split roller design allows the rollers to be injection molded one embodiment, this results in a perfectly round concentric hole producing a smooth and round exterior. This method eliminates the seam (parting line), seam failure (cracking) and offset mating problems that can be present with single roller design.

Note that the outward tapered flange has at least three unique benefits: (1) the flanges centralize the jack on the pole; (2) the taper on the flange keeps them from damaging the labels and allowing the jack to pivot (twist) under lateral tension without binding; and (3) the flange is of a size that will not allow the pole to ride out of the roller channel.

Note that although the various embodiments described herein include a top roller, a middle roller, a split lower roller and a split workbench roller, it is contemplated that one or more additional rollers of any one or more of the above types may be used in a pump jack that has additional rods that may come into contact with the pole.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A roller system comprising a top roller, a middle roller and a split lower roller configured for a pump jack arranged for travelling up and down a pole, wherein the pump jack comprises a frame member; a bracket member supported on the top of said frame member, said bracket member supporting a front rod; a lower shackle member supported on said frame member, having a front and rear clamping bars configured to apply a coupling force for gripping the pole, wherein the rear clamping bar is inserted into the split lower roller; a pump arm pivotally coupled to said frame member; an upper shackle member pivotally coupled to said pump arm, having a front gripping rod and a rear gripping rod configured to apply a coupling force for gripping the pole, wherein the rear gripping rod is inserted into the middle roller; tension springs responsive to the pumping action of the pump arm configured to alternately position one of said shackle members in gripping relationship with the pole; said pump arm pivotally stepping upward said frame member during a pump stroke while said upper shackle member grips the pole and pivotally stepping upward said upper shackle member during a reverse stroke while said lower shackle member grips the pole; a release lever configured to disengage said lower shackle member from the pole, and a handle coupled to said front gripping rod configured to roll the pump jack down the pole;

wherein the front rod is inserted into the top roller configured to roll along a front surface of the pole;

wherein the split lower roller comprises a pair of facing lower rollers, each of the pair of facing lower rollers having an outward tapered flange.

2. The roller system of claim 1 further comprising a split workbench roller, wherein the pump jack further comprises a platform support fixedly projecting from said frame member, said platform support comprises a rear rod; wherein the rear rod is inserted into the split workbench roller configured to roll along a rear surface of the pole; wherein the split workbench roller comprises a pair of facing workbench rollers, each of the pair of facing workbench rollers having an outward tapered flange.

3. The roller system of claim 1, wherein the tapered flanges are configured to cause the pump jack to center with the pole.

4. The roller system of claim 1, wherein the taper on the flanges is configured to keep the roller from damaging a label attached on the pole.

5. The roller system of claim 1, wherein the taper on the flanges allows the jack to pivot under lateral tension without binding.

6. The roller system of claim 1, wherein the size of the flange is selected to prevent the pole to ride out of a roller channel.

7. The roller system of claim 1, wherein the top roller, the middle roller and the pair of facing lower rollers are made of a nylon material.

8. The roller system of claim 2, wherein the top roller, the middle roller, the pair of facing lower rollers and the pair of facing workbench rollers are made of a nylon material.

9. The roller system of claim 7, wherein the top roller, the middle roller and the pair of facing lower rollers are injection molded such that there is no seam on a cylindrical surface of the rollers.

10. The roller system of claim 8, wherein the top roller, the middle roller, the pair of facing lower rollers and the pair of facing workbench rollers are injection molded such that there is no seam on a cylindrical surface of the rollers.

11. A pump jack arranged for travelling up and down a pole, comprising:

a frame member;

a bracket member supported on the top of said frame member, said bracket member supporting a front rod inserted into a top roller configured to roll along a front surface of the pole;

a lower shackle member supported on said frame member, having a front clamping bar and a rear clamping rod configured to apply a coupling force for gripping the pole, wherein the rear clamping rod is inserted into a split lower roller;

a pump arm pivotally coupled to said frame member;

an upper shackle member pivotally coupled to said pump arm, having a front gripping rod and a rear gripping rod configured to apply a coupling force for gripping the pole, wherein the rear gripping rod is inserted into a middle roller;

tension springs responsive to the pumping action of the pump arm configured to alternately position one of said shackle members in gripping relationship with the pole;

said pump arm pivotally stepping upward said frame member during a pump stroke while said upper shackle member grips the pole and pivotally stepping upward said upper shackle member during a reverse stroke while said lower shackle member grips the pole;

a release lever configured to disengage said lower shackle member from the pole, and a handle coupled to said front gripping rod configured to roll the pump jack down the pole;

wherein the top roller comprises flanges at both ends of the roller;

wherein the split lower roller comprises a pair of facing lower rollers, each of the pair of facing lower rollers having an outward tapered flange.

12. The pump jack of claim 11, further comprising a platform support fixedly projecting from said frame member, said platform support comprises a rear rod inserted into a split workbench roller configured to roll along a rear surface of the pole; wherein the split workbench roller comprises a pair of facing workbench rollers, each of the pair of facing workbench rollers having an outward tapered flange.

13. The pump jack of claim 11, wherein the tapered flanges are configured to cause the pump jack to center with the pole.

14. The pump jack of claim 11, wherein the taper on the flanges is configured to keep the roller from damaging a label attached on the pole.

15. The pump jack of claim 11, wherein the taper on the flanges allows the jack to pivot under lateral tension without binding.

16. The pump jack of claim 11, wherein the size of the flange is selected to prevent the pole to ride out of a roller channel.

17. The pump jack of claim 11, wherein the top roller, the middle roller and the pair of facing lower rollers are made of a nylon material.

18. The pump jack of claim 12, wherein the top roller, the middle roller, the pair of facing lower rollers and the pair of facing workbench rollers are made of a nylon material.

19. The pump jack of claim 17, wherein the top roller, the middle roller and the pair of facing lower rollers are injection molded such that there is no seam on a cylindrical surface of the rollers.

20. The pump jack of claim 18, wherein the top roller, the middle roller, the pair of facing lower rollers and the pair of facing workbench rollers are injection molded such that there is no seam on a cylindrical surface of the rollers.

* * * * *